US006328609B1

(12) United States Patent
Ezawa et al.

(10) Patent No.: US 6,328,609 B1
(45) **Date of Patent: *Dec. 11, 2001**

(54) MODULAR JACK

(75) Inventors: Katsuya Ezawa; Toru Watanabe, both of Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/137,108

(22) Filed: Aug. 20, 1998

(30) Foreign Application Priority Data

Aug. 28, 1997 (JP) ..... 9-232208
Mar. 10, 1998 (JP) ..... 10-058220

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | | |
|---|---|---|---|---|
| 4,269,467 | * | 5/1981 | Hughes | 439/676 |
| 5,011,435 | * | 4/1991 | Seong et al. | 439/676 |
| 5,362,257 | * | 11/1994 | Neal et al. | 439/676 |
| 5,478,261 | * | 12/1995 | Bogese, II | 439/676 |
| 5,586,914 | * | 12/1996 | Foster | 439/676 |
| 5,626,497 | * | 5/1997 | Bouchan et al. | 439/676 |
| 5,639,266 | * | 6/1997 | Patel | 439/941 |
| 5,647,770 | * | 7/1997 | Belopolsky | 439/676 |
| 5,697,817 | * | 12/1997 | Bouchan et al. | 439/941 |

* cited by examiner

*Primary Examiner*—Paula Bradley
*Assistant Examiner*—Briggitte R. Hammond
(74) *Attorney, Agent, or Firm*—Kanesaka & Takeuchi

(57) ABSTRACT

The crosstalk between the terminal pairs is reduced by providing the vertical offsets in the terminal arrangement to reduce the overlap between adjacent terminals and further increasing the distance between the terminal pairs.

6 Claims, 8 Drawing Sheets

MODULAR JACK

BACKGROUND OF THE INVENTION

1. Field of the Invention

The present invention relates to modular jacks and, more particularly, to a modular jack with crosstalk reduced by changing the arrangement and shape of terminals.

2. Description of the Related Art

An electric current flowing in a line or terminal induces by electromagnetic or static coupling another electric current in another line or terminal, producing a crosstalk. The crosstalk interferes with signal transmission or causes noise, and many ideas have been proposed to reduce the crosstalk.

Modular jacks and plugs are widely used for telephone sets or local area networks. A modular plug is connected to a plurality of core wires of a cable used for a telephone set or LAN. A modular jack is provided in equipment and receives the modular plug. When the modular plug is plugged in the modular jack, the terminals of the modular jack are connected to the core wires of the modular plug.

Japanese patent application Kokai Nos. 7-302641, 7-106010, and 8-507648 disclose a variety of means for reducing the crosstalk in the modular jack.

The first and second Japanese patents disclose a modular jack in which some of terminals are modified to reduce overlaps of adjacent terminals to thereby minimize the crosstalk.

The third Japanese patent discloses a similar modular jack, in which the overlaps of adjacent terminals are reduced to minimize the crosstalk, having six long terminals and two short terminals arranged in separate planes so that the long and short terminals do not overlap each other, thereby minimizing the crosstalk.

In the first and second prior art, the crosstalk is not solved completely. The third prior art, which employs the two kinds of terminals to avoid overlaps of adjacent terminals, has the following problems.

The different lengths of terminals make the transmission times of signals different. Individual electric signals should reach the equipment at the same time through the modular plug and jack. As electrical signals are speeded up, the difference in transmission time presents a problem.

When the differently shaped terminals are used, the contact pressures on the modular plug are different for each type of terminals, making the equipment less reliable.

SUMMARY OF THE INVENTION

Accordingly, it is an object of the invention to provide a modular jack having the reduced crosstalk by changing the length and shape of the terminals without providing different transmission time or contact pressure.

According to the invention there is provided a modular jack for receiving a modular plug having a plurality of first contact terminals, which comprises a plurality of second contact terminals. The second contact terminals comprises a plurality of contact sections arranged in a plane for contact with the first contact terminals; a plurality of fixed sections fixed to the modular jack; and a plurality of attaching sections exposed from the modular jack. The modular jack is characterized in that the fixed sections are arranged in a plurality of different planes.

It is preferred that the different planes includes different horizontal planes. The contact terminals make a plurality of pairs and a distance between the pairs is changed. The contact terminals are eight contact terminals (a, b, c, e) and (d, f, g, h) arranged in upper and lower planes, respectively. The contact terminals consist of four pairs of contact terminals a and b, c and f, d and e, and g and h, with a distance between the pair a and b or the pair g and h and the pair c and f or d and e being increased. The distance is increased in either vertical or horizontal direction of the contact terminals. The contact terminals have substantially the same length.

DESCRIPTION OF THE PREFERRED EMBODIMENTS

Embodiments of the invention will be described with reference to the accompanying drawings.

Figure 1:
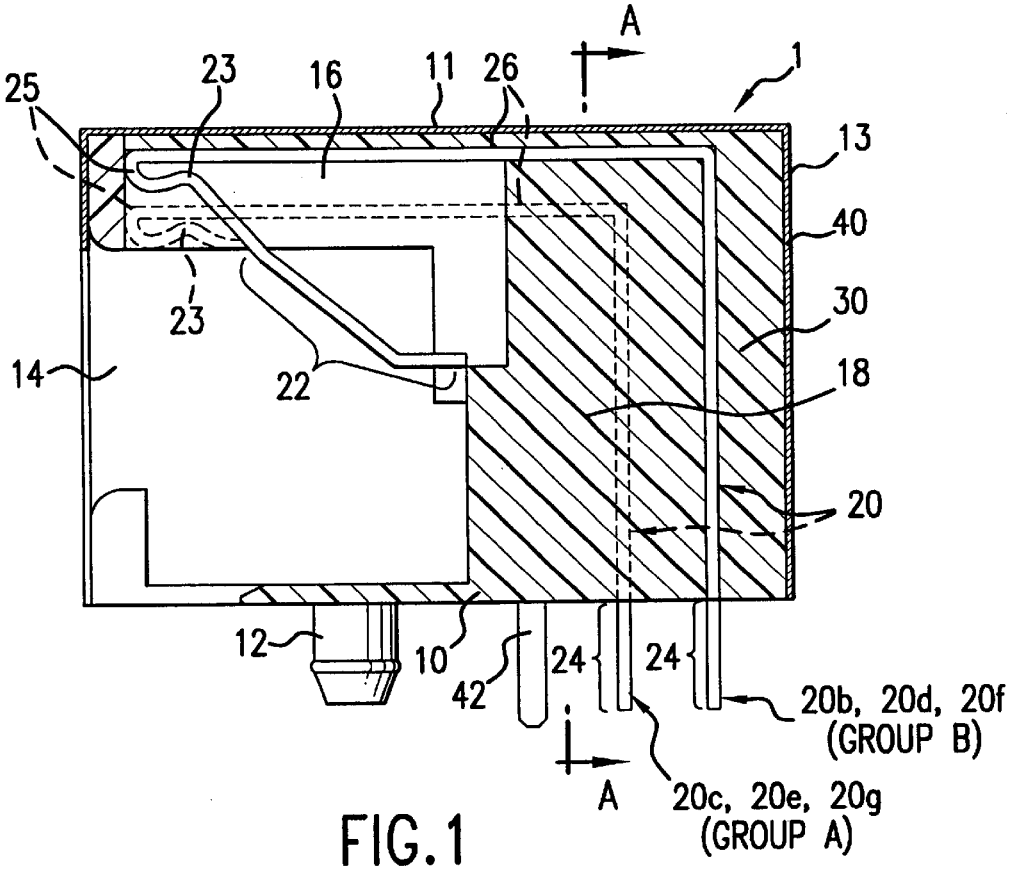
FIG. 1 is a sectional view of a modular jack of the downward lever type according to an embodiment of the invention.
Figure 2:
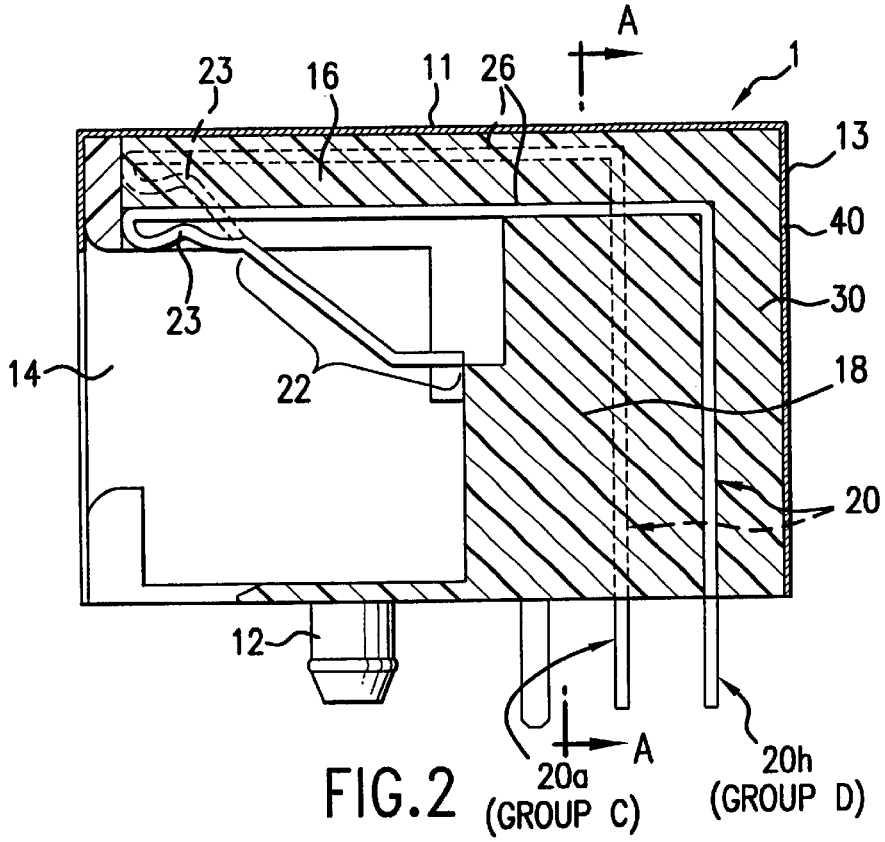
FIG. 2 is a sectional view of the modular jack.

FIGS. 1 and 2 show in section a modular jack of the downward lever type according to an embodiment of the invention. When a modular plug is plugged in the modular jack, the contact terminals of the modular jack are brought into contact with the contact terminals of the modular plug. FIG. 1 shows the positions of terminals 20*c*, 20*e*, and 20*g*, and 20*b*, 20*d*, and 20*f*, and FIG. 2 shows the positions of terminals 20*a* and 20*h*.

A modular jack 1 comprises an insulation housing 10, eight terminals 20 (20*a*–*h*) arranged in the insulation housing 10, a terminal fixing board 30 to fix the terminals 20 in the insulation housing 10, and a ground plate 40 to cover the insulation housing 10 except for an opening and the bottom of the insulation housing.

The insulation housing 10 is a body of the modular jack 1 to which other components are attached. The modular jack is attached to equipment (not shown) by inserting a pair of guide posts 12 into holes of a wiring board of the equipment.

An opening 14 is provided in front face of the insulation housing 10 to receive a modular plug (not shown). When a modular plug is plugged in the modular jack, the terminals of the modular plug are brought into contact with the corresponding terminals of the modular jack. The terminals 20 of the modular jack are arranged such that the contact sections 22 are exposed and arranged in a plane in the opening 14.

The insulation housing 10 is provided with a plurality of grooves (not shown) in an upper wall 16 and a rear wall 18.

The upper sections of the grooves in the upper wall 16 open at the opening 14 so that the contact sections 22 are exposed in the opening 14. The terminals 20 are linked together before arrangement in the insulation housing 10 as described below.

1) A flat metal sheet is stamped to provide eight terminals linked at rear ends.

2) Front portions of the terminals are gilded. Since the terminals have substantially the same length, it is easy to gild the front portions for a predetermined distance from the front ends.

3) Then, the terminals are bent in four different shapes. The terminals 20*c*, 20*e*, and 20*g* of FIG. 1 make Group 1, 20*b*, 20*d*, and 20*f* of FIG. 1 Group 2, 20*a* of FIG. 2 Group 3, and 20*h* of FIG. 2 Group 4. The lengths of the terminals are slightly different among the Groups but not so much as to affect the gilding and the functions of a modular jack.

4) The shaped terminals are arranged in the grooves of the insulation housing. Since the terminals are linked together at the rear ends, this operation is made by one step.

5) After arrangement in the insulation housing 10, the individual terminals are separated by cutting the rear link. Each terminal 20 has a contact section 22 exposed in the opening 14 for contact with a terminal of the modular plug, an attaching section 24 projecting from the bottom of the insulation housing 10 to be attached to the wiring board, and a fixed section 26 fixed in the insulation housing 10.

These three sections of terminals in the same group are arranged in the same plane but at least one of these sections is offset from the section of a terminal in the other group. There are two kinds of offset; the vertical offset and the lateral offset in the direction of insertion of the modular plug. The lateral offset, which is determined by the standards, is not critical here. According to the invention, there is provided a vertical offset to shorten the vertical sections of some terminals to minimize the crosstalk.

1) There is no offset at the contact section 22. The contact sections of all terminals are arranged in the same plane so that the contact sections of a modular plug are brought into contact with those of a modular jack.

2) The attaching section 24 has only the lateral offset which is determined by the standards.

Figure 3:
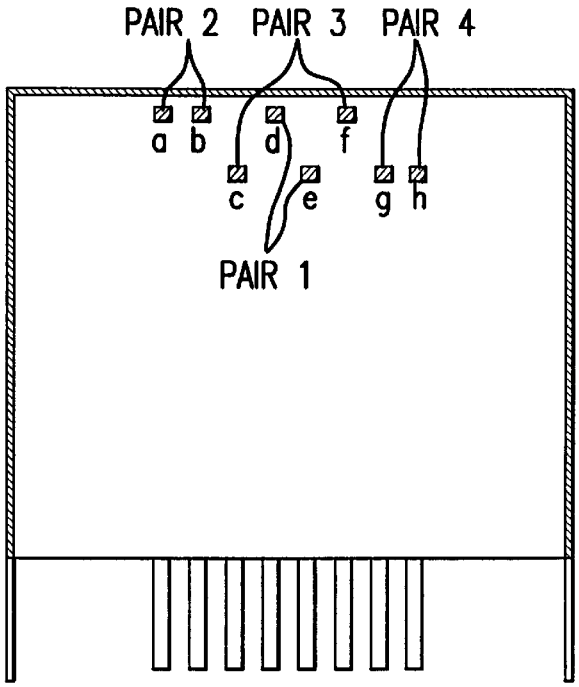
FIG. 3 is a sectional view taken along line A—A of FIGS. 1 and 2.

3) The fixed section has both the vertical offset and the lateral offset. As shown in FIG. 3 which is a section taken along line A—A of FIGS. 1 and 2, the terminals 20*c*, 20*e*, and 20*g* of Group 1 and the terminal 20*h* of Group 3 are arranged at a lower level while the terminals 20*b*, 20*d*, and 20*f* of Group 2 and the terminal 20*a* of Group 4 are arranged at an upper level.

The terminals 20*d* and 20*e* make Pair 1, the terminals 20*a* and 20*b* Pair 2, the terminals 20*c* and 20*f* Pair 3, and the terminals 20*g* and 20*h* Pair 4. Each pair corresponds to one of the four twisted pairs in a cable connected to a modular plug. A wire of the pair, for example, at the terminal 20*a*, 20*c*, 20*d*, or 20*g*, corresponds to one of the corresponding twisted pair while the other wire, for example, at the terminal 20*b*, 20*e*, 20*f*, or 20*h*, corresponds to the other one of the twisted pair. An electrical signal is transmitted by these corresponding wires.

According to the invention there is provided a vertical offset to reduce overlap of adjacent terminals to minimize the crosstalk. The vertical offset according to the invention has been proven to be effective by experiments.

The fixing board 30 is made in an L-shaped form so that when it is attached to the insulation housing 10 by sliding it along channels (not shown) on the insulation housing 10, it closes the grooves in the upper wall 16 and the rear wall 18 of the opening 14 or the top and rear faces of the insulation housing 10 to fix the terminals in the groove.

The ground plate 40 protects the insulation housing 10 from impacts and functions as a ground. After the ground plate 40 is attached to the insulation housing 10, a downward projection 42 is connected to the wiring board.

Figure 4:
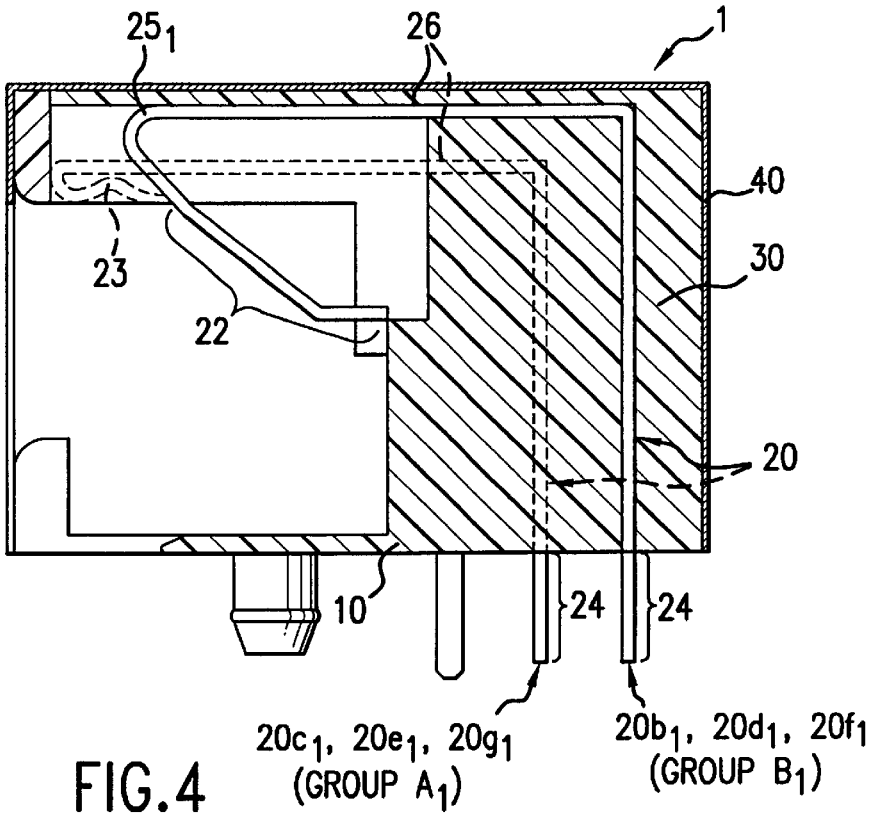
FIG. 4 is a sectional view of a modular jack according to the second embodiment of the invention.
Figure 5:
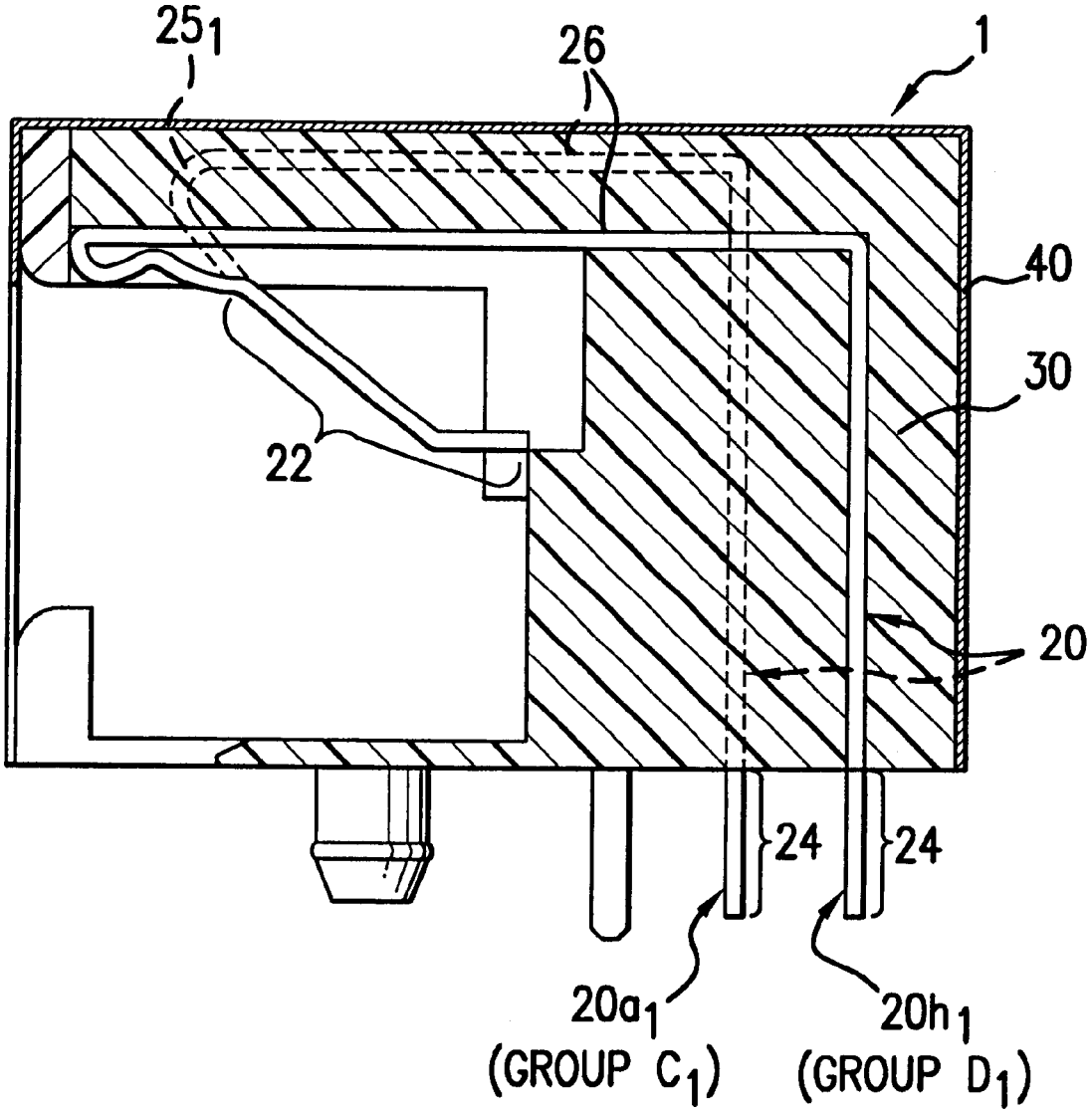
FIG. 5 is a sectional view of the second modular jack.

FIGS. 4 and 5 show a modular jack according to another embodiment of the invention. This embodiment is almost identical with that of FIGS. 1–2 except for the terminals.

Only terminals $\mathbf{20}b_1$, $\mathbf{20}d_1$, and $\mathbf{20}f_1$ of Group $B_1$ and terminal $\mathbf{20}a_1$ of Group $C_1$ are different from the embodiment of FIGS. 1–2. The terminals $\mathbf{20}c_1$, $\mathbf{20}e_1$, $\mathbf{20}g_1$, and $\mathbf{20}h_1$ of Groups $A_1$ and $D_1$ are identical with those of FIGS. 1 and 2. The bending position $\mathbf{25}_1$ of the terminals in Groups $B_1$ and $C_1$ is closer to the rear wall of the insulation housing 10 than the bending position 25 of the terminals in FIGS. 1 and 2. Consequently, the contact pressure of the contact sections 22 is reduced and, therefore, it is not necessary to provide a U-shaped portion 23 as shown in FIGS. 1 and 2.

Figure 6B:
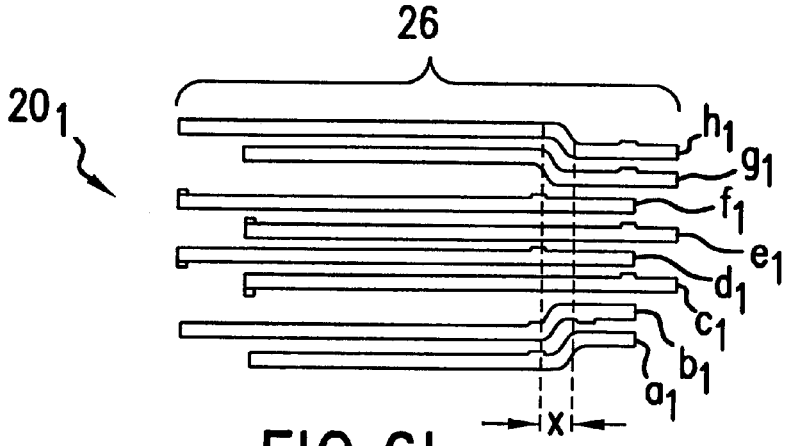
FIG. 6 shows terminal arrangement in which the terminal pitch is changed.
Figure 6C:
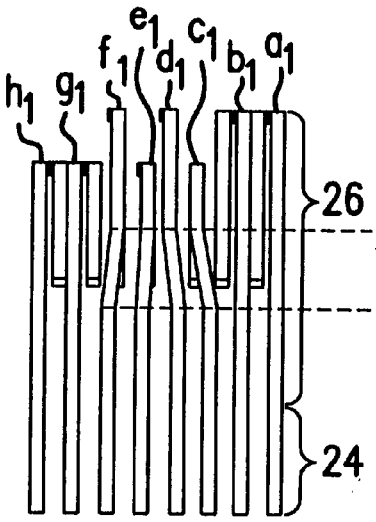
Figure 6A:
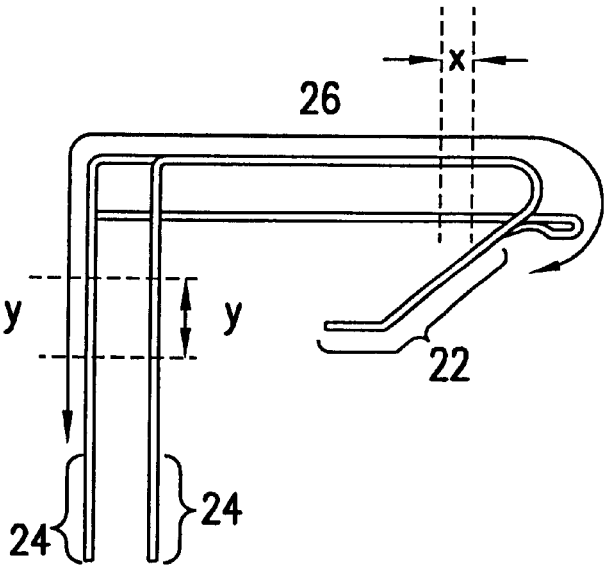

As shown in FIGS. 1–5, the vertical offset of terminal arrangement is helpful for reducing the crosstalk. In FIG. 6, the distance between the pairs is increased to further minimize the crosstalk. FIGS. 6(*a*), (*b*), and (*c*) are side, top, and rear views of the terminal arrangement.

As shown in FIG. 6(*b*), the pair of terminals $\mathbf{20}a_1$ and $\mathbf{20}b_1$ and the pair of terminals $\mathbf{20}g_1$ and $\mathbf{20}h_1$ are bent outwardly at the upper horizontal portions "x" of the fixed sections to increase the distance between the pairs. As shown in FIG. 6(*c*), the pair of terminals $\mathbf{20}c_1$ and $\mathbf{20}f_1$ and the pair of terminals $\mathbf{20}d_1$ and $\mathbf{20}e_1$ are bent outwardly at the vertical portions "y" of the fixed sections to increase the distance between the pairs. Consequently, the distance between the pairs of terminals $\mathbf{20}a_1$ and $\mathbf{20}b_1$ and the pair of terminals $\mathbf{20}c_1$ and $\mathbf{20}f_1$ or $\mathbf{20}d_1$ and $\mathbf{20}e_1$, and the pair of terminals $\mathbf{20}g_1$ and $\mathbf{20}h_1$ and the pair of terminals $\mathbf{20}c_1$ and $\mathbf{20}f_1$ or $\mathbf{20}d_1$ and $\mathbf{20}e_1$ is increased to thereby minimized the crosstalk.

Figure 7:
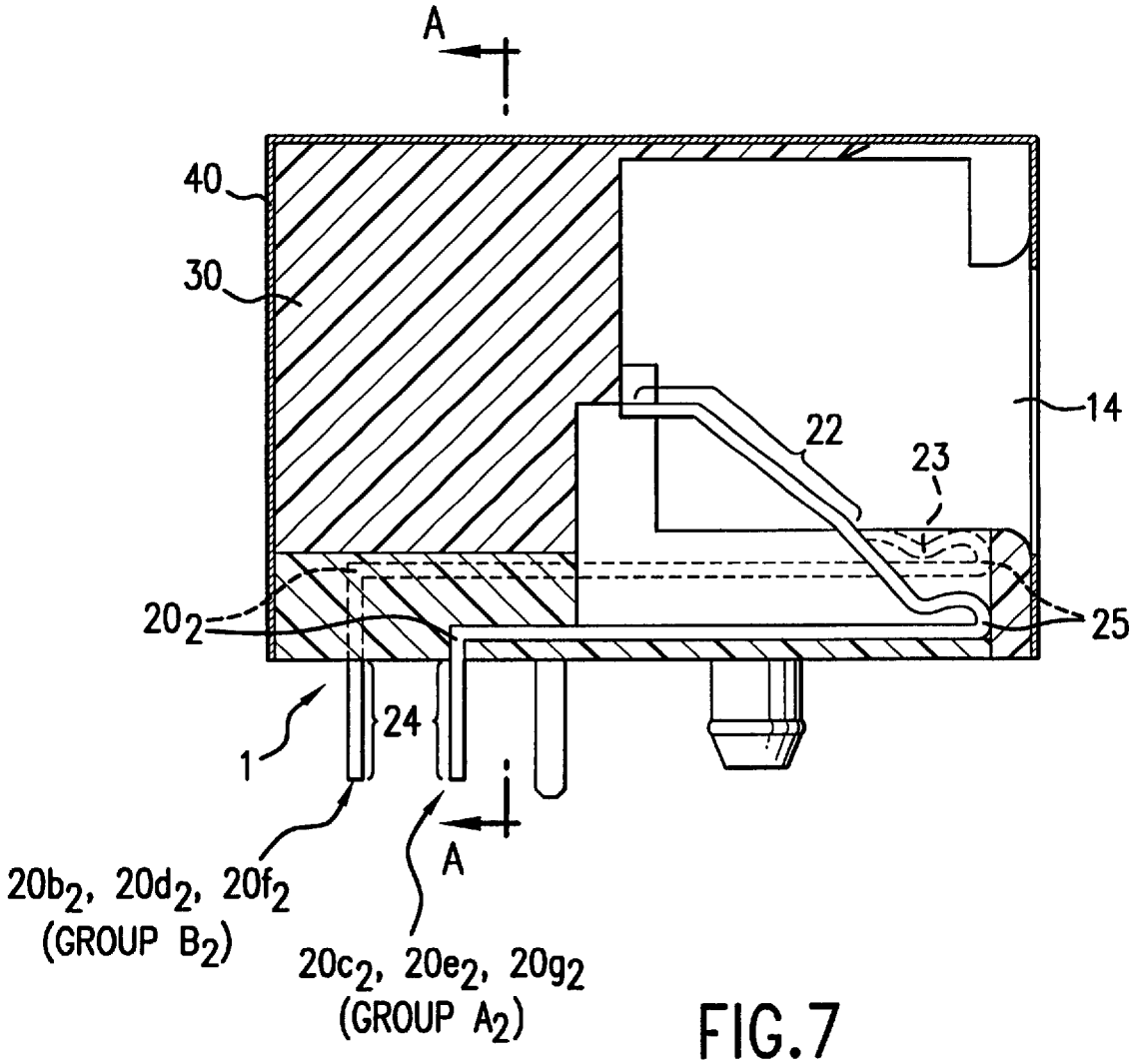
FIG. 7 is a sectional view of a modular jack of the upward lever type according to the third embodiment of the invention.

FIG. 7 shows a modular jack of the upward lever type according to the third embodiment of the invention. The contact terminals $\mathbf{20}_2$ are arranged in the bottom of the opening 14 so that when a modular plug is plugged in, the lower sides of contact terminals of the modular plug are brought into contact with the upper sides of contact terminals of the modular jack. Since the vertical portions of the fixed sections are too short to change the distance between the terminal pairs, the horizontal portions of the fixed sections are bent as described hereinafter with reference to FIG. 8. FIG. 7 shows especially the positions and shapes of terminals $\mathbf{20}c_2$, $\mathbf{20}e_2$, $\mathbf{20}g_2$ (Group $A_2$) and $\mathbf{20}b_2$, $\mathbf{20}d_2$, $\mathbf{20}f_2$ (Group $B_2$). As for the terminal $\mathbf{20}a_2$ and $\mathbf{20}h_2$, it is obvious from FIGS. 1 and 2.

Figure 8B:
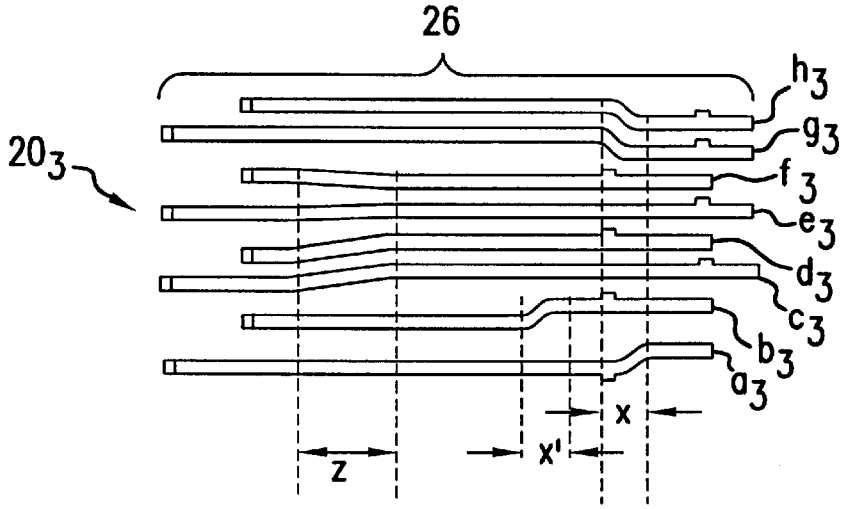
FIG. 8 shows a terminal arrangement of the third embodiment.
Figure 8A:
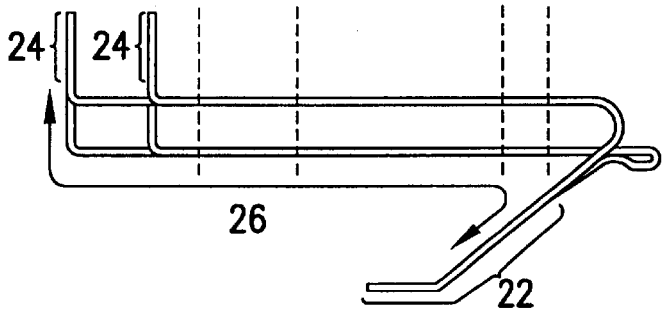
Figure 8C:
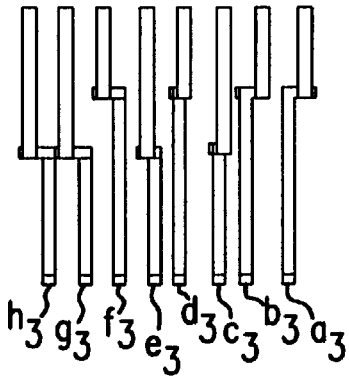

FIGS. 8(*a*), (*b*), and (*c*) are side, top, and rear views of the arrangement of terminals $\mathbf{20}_3$. As shown in FIG. 8(*b*), in addition to the portions "x" and "x'" of the fixed sections, the portions "z" of the terminal pair $\mathbf{20}c_3$ and $\mathbf{20}f_3$ and terminal pair $\mathbf{20}d_3$ and $\mathbf{20}e_3$ are bent outwardly to increase the distance between the terminal pair $\mathbf{20}a_3$ and $\mathbf{20}b_3$ and the terminal pair $\mathbf{20}c_3$ and $\mathbf{20}f_3$ or the terminal pair $\mathbf{20}d_3$ and $\mathbf{20}e_3$ and the terminal pair $\mathbf{20}g_3$ and $\mathbf{20}h_3$ and the terminal pair $\mathbf{20}c_3$ and $\mathbf{20}f_3$ or the terminal pair $\mathbf{20}d_3$ and $\mathbf{20}e_3$, thereby minimizing the crosstalk. The position "x'" of the terminal 20*b*3 is slightly offset from the position "x" of the terminals $\mathbf{20}a_3$, $\mathbf{20}g_3$, and $\mathbf{20}h_3$, but this offset has little adverse effect on the crosstalk reduction.

Figures 9A, 9B:
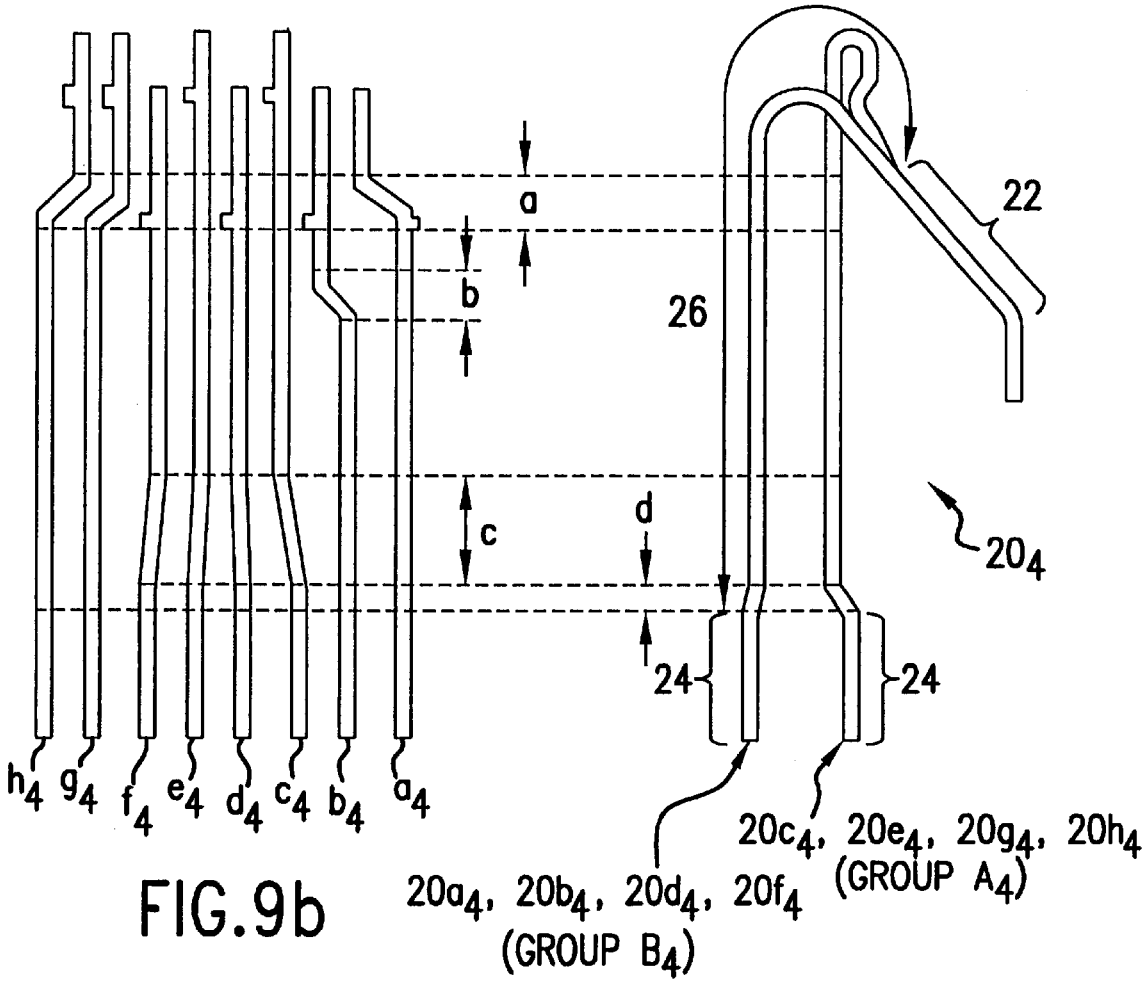
FIG. 9 shows an arrangement of straight terminals for the fourth embodiment.

FIG. 9 shows the arrangement of terminals of the straight type according to the fourth embodiment of the invention. A modular jack of this type receives a modular plug from above. FIGS. 9(*a*) and (*b*) are side and rear views of the terminal arrangement, respectively.

The terminals $\mathbf{20}_4$ are bent in the vertical portions "a", "b", and "c" to increase the distances between the terminal pairs. In addition, the terminals $\mathbf{20}c_4$, $\mathbf{20}e_4$, $\mathbf{20}g_4$, and $\mathbf{20}h_4$ (Group $A_4$) and the terminals $\mathbf{20}a_4$, $\mathbf{20}b_4$, $\mathbf{20}d_4$, and $\mathbf{20}f_4$ (Group $B_4$) are bent outwardly at the vertical portions "d" to increase the distance between the two groups (not pairs). Consequently, the crosstalk between the terminals of these groups is further reduced.

Figure 10:
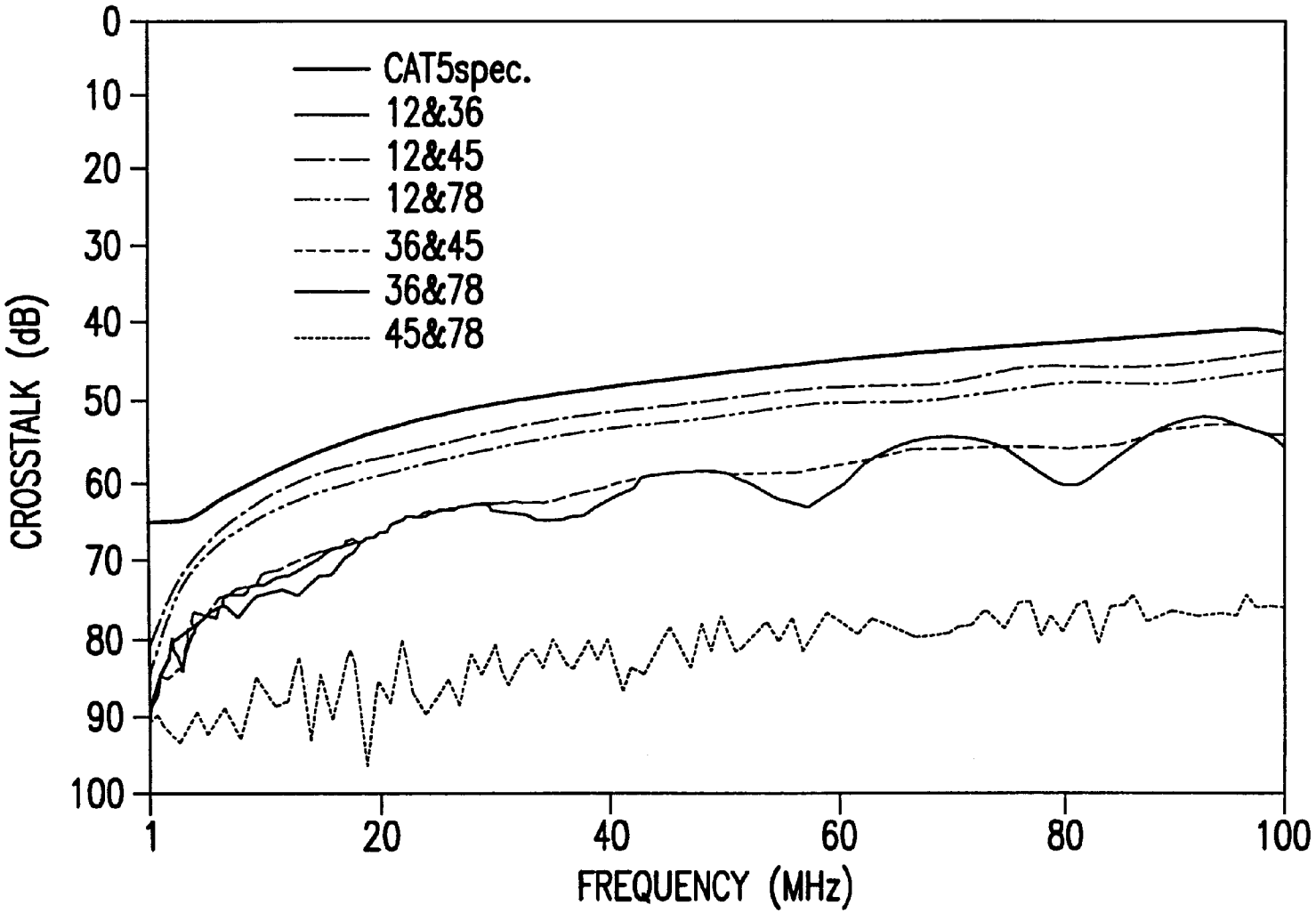
FIG. 10 is a graph showing the crosstalk characteristics of the modular jack according to the invention.

FIG. 10 shows the crosstalk characteristics of the modular jack according to the invention. The horizontal and vertical axis represent the frequency (MHz) and the crosstalk (dB), respectively. The bold solid line represents the well known "category 5 spec." It is preferred that the crosstalk does not exceed this line. Heretofore, some terminal pairs meet the requirement but others do not. According to the invention, all of the terminal pairs meet this requirement. Even the worst crosstalk represented by the one-dot chain line which occurs between the terminals 20*d* and 20*e* and the terminals 20*g* and 20*h* is below the bold solid line.

By providing the vertical offsets to reduce the overlap between adjacent terminals and by controlling the length and shape of the terminals, it is possible to provide a modular jack having the reduced cross talk. By increasing the distance between the terminal pairs it is possible to further reduce the crosstalk.

What is claimed is:

1. A module jack for receiving a modular plug having a plurality of contact terminals, comprising:

an insulation housing having an opening at a front face; and eight L-shaped contact terminals, a first, a second, a third, a fourth, a fifth, a sixth, a seventh, and an eighth terminals provided in this order in said insulation housing, wherein said eight L-shaped contact terminals make four pairs, a first pair consisting of said fourth and fifth terminals, a second pair consisting of said first and second terminals, a third pair consisting of said third and sixth terminals, and a fourth pair consisting of said seventh and eighth terminals, said L-shaped contact terminals including:

fixed sections including horizontal and vertical portions and fixed to said insulation housing, wherein horizontal portions of said first, second, fourth and sixth terminals are arranged in an upper level and horizontal portions of said third, fifth, seventh and eighth terminals are arranged in a lower level;

contact sections extending diagonally and downwardly from said horizontal portion of said fixed sections, wherein all contact sections of said contact terminals of said modular jack extend straight in a direction and in a plane in said opening for contact with said contact terminals of said modular plug when said modular plug is plugged in said modular jack; and attaching sections extending downwardly from said insulation housing, wherein a distance between said second and fourth pairs is increased by laterally bending a part of said horizontal portions of said first, second, seventh, and eighth terminals, and a distance between said first and third pairs is increased by laterally bending a part of said vertical portions of said third, fourth, fifth, and sixth terminals.

2. A module jack according to claim 1, wherein distances between said second and third pairs, said second and first pairs, said fourth and third pairs, and said fourth and first pairs are increased by bending said parts of said horizontal and vertical portions of said fixed sections.

3. A module jack for receiving a modular plug having a plurality of contact terminals, comprising:

an insulation housing having an opening at a front face; and eight L-shaped contact terminals, a first, a second, a third, a fourth, a fifth, a sixth, a seventh, and an eighth terminals provided in this order in said insulation housing, wherein said eight L-shaped contact terminals make four pairs, a first pair consisting of said fourth and fifth terminals, a second pair consisting of said first and second terminals, a third pair consisting of said third and sixth terminals, and a fourth pair consisting of said seventh and eighth terminals, said contact terminals including:

fixed sections including relatively long horizontal portions and relatively short vertical portions and fixed to said insulation housing, wherein horizontal portions of said first, second, fourth and sixth terminals are arranged in a lower level and horizontal portions of said third, fifth, seventh and eighth terminals are arranged in an upper level;

contact sections extending diagonally and upwardly from said horizontal portions of said fixed sections, wherein all of contact sections of said contact terminals of said modular jack extending straight in a direction and in a plane in said opening for contact with said contact terminals of said modular plug when said modular plug is plugged in said modular jack; and attaching sections extending downwardly from said insulation housing, wherein a distance between said second and fourth pairs is increased by laterally bending a part of said horizontal portions of said first, seventh, and eighth terminals and a part of said horizontal portion of said second terminal, and a distance between said first and third pairs is increased by laterally bending a third part of said horizontal portions of said third, fourth, fifth, and sixth terminals.

4. A module jack according to claim 3, wherein distances between said second and third pairs, said second and first pairs, said fourth and third pairs, and said fourth and first pairs are increased by bending said parts of said horizontal portions of said fixed sections.

5. A module jack for receiving a modular plug having a plurality of contact terminals, comprising:

an insulation housing having an opening at a front face; and eight straight contact terminals, a first, a second, a third, a fourth, a fifth, a sixth, a seventh, and an eighth terminal provided in this order in said insulation housing, wherein said eight contact terminals make four pairs, a first pair consisting of said fourth and fifth terminals, a second pair consisting of said first and second terminals, a third pair consisting of said third and sixth terminals, and a fourth pair consisting of said seventh and eighth terminals, and two groups, a first group consisting of said first, second, fourth, and sixth terminals and a second group consisting of said third, fifth, seventh, and eighth terminals, said contact terminals including:

fixed sections including vertical portions and fixed to said insulation housing, wherein vertical portions of said first group are arranged in a first vertical plane and vertical portions of said second group are arranged at a second vertical plane, and a distance between vertical portions of said first and second groups is increased by bending a part of said vertical portions of said first and second groups;

contact sections extending diagonally and downwardly from said vertical portions, wherein all of contact sections of said contact terminals of said modular jack extend straight in a direction and in a plane in said opening for contact with said contact terminals of said modular plug when said modular plug is plugged in said modular jack; and attaching sections extending in a vertical direction and projecting outwardly from said insulation housing, wherein a distance between said second and fourth pairs is increased by laterally bending a part of said vertical portions of said first, seventh, and eighth terminals and a part of said vertical portion of said second terminal, and a distance between said first and third pairs is increased by laterally bending a part of said vertical portions of said third, fourth, fifth, and sixth terminals.

6. A module jack according to claim 5, wherein distances between said second and third pairs, said second and first pairs, said fourth and third pairs, and said fourth and first pairs are increased by bending said parts of said vertical portions of said fixed sections.

* * * * *